US006899032B2

(12) United States Patent
Ronn et al.

(10) Patent No.: US 6,899,032 B2
(45) Date of Patent: May 31, 2005

(54) DEVICE TO ENABLE TARGETS TO BE COMBATED BY A SHAPED CHARGE FUNCTION

(75) Inventors: Torsten Ronn, Karlskoga (SE); Nils Johansson, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 11 days.

(21) Appl. No.: 10/312,888

(22) PCT Filed: Jun. 20, 2001

(86) PCT No.: PCT/SE01/01406

§ 371 (c)(1),
(2), (4) Date: Jul. 11, 2003

(87) PCT Pub. No.: WO02/03010

PCT Pub. Date: Jan. 10, 2002

(65) Prior Publication Data

US 2004/0035313 A1 Feb. 26, 2004

(30) Foreign Application Priority Data

Jul. 3, 2000 (SE) ..... 00024836

(51) Int. Cl.[7] ..... F42B 1/02
(52) U.S. Cl. ..... 102/307; 102/306; 102/476
(58) Field of Search ..... 102/476, 306–310

(56) References Cited

U.S. PATENT DOCUMENTS 4,776,272 A 10/1988 Lindstadt et al.
5,509,357 A 4/1996 Lawther
5,939,663 A 8/1999 Walters et al.
6,349,649 B1 * 2/2002 Jacoby et al. ..... 102/307
6,354,219 B1 * 3/2002 Pratt et al. ..... 102/307
6,588,344 B2 * 7/2003 Clark et al. ..... 102/307
6,668,726 B2 * 12/2003 Lussier ..... 102/307

FOREIGN PATENT DOCUMENTS

| | | |
|---|---|---|
| DE | 1128345 | 4/1962 |
| DE | 3501649 A1 | 7/1986 |
| DE | 3609865 C1 | 7/1997 |
| GB | 709082 | 5/1954 |
| GB | 2170888 A | 8/1986 |

* cited by examiner

*Primary Examiner*—Michael J. Carone
*Assistant Examiner*—T. Nguyen
(74) *Attorney, Agent, or Firm*—Connolly Bove Lodge & Hutz LLP; Larry J. Hume

(57) ABSTRACT

A device arranged to enable the engagement of targets (5) by means of a shaped charge function. An ammunition unit is arranged to operate with at least two configuration modes where in the first mode the ammunition unit comprises solely a first modular charge (3). In the second mode the first modular charge is conjoined with a second modular charge (4). The modular charges each effect their own type of shaped charge function. Another feature is that the ammunition unit is arranged to enable changeover from the first configuration to the second before firing, launch or release of the ammunition unit.

18 Claims, 2 Drawing Sheets

DEVICE TO ENABLE TARGETS TO BE COMBATED BY A SHAPED CHARGE FUNCTION

Figure 1:
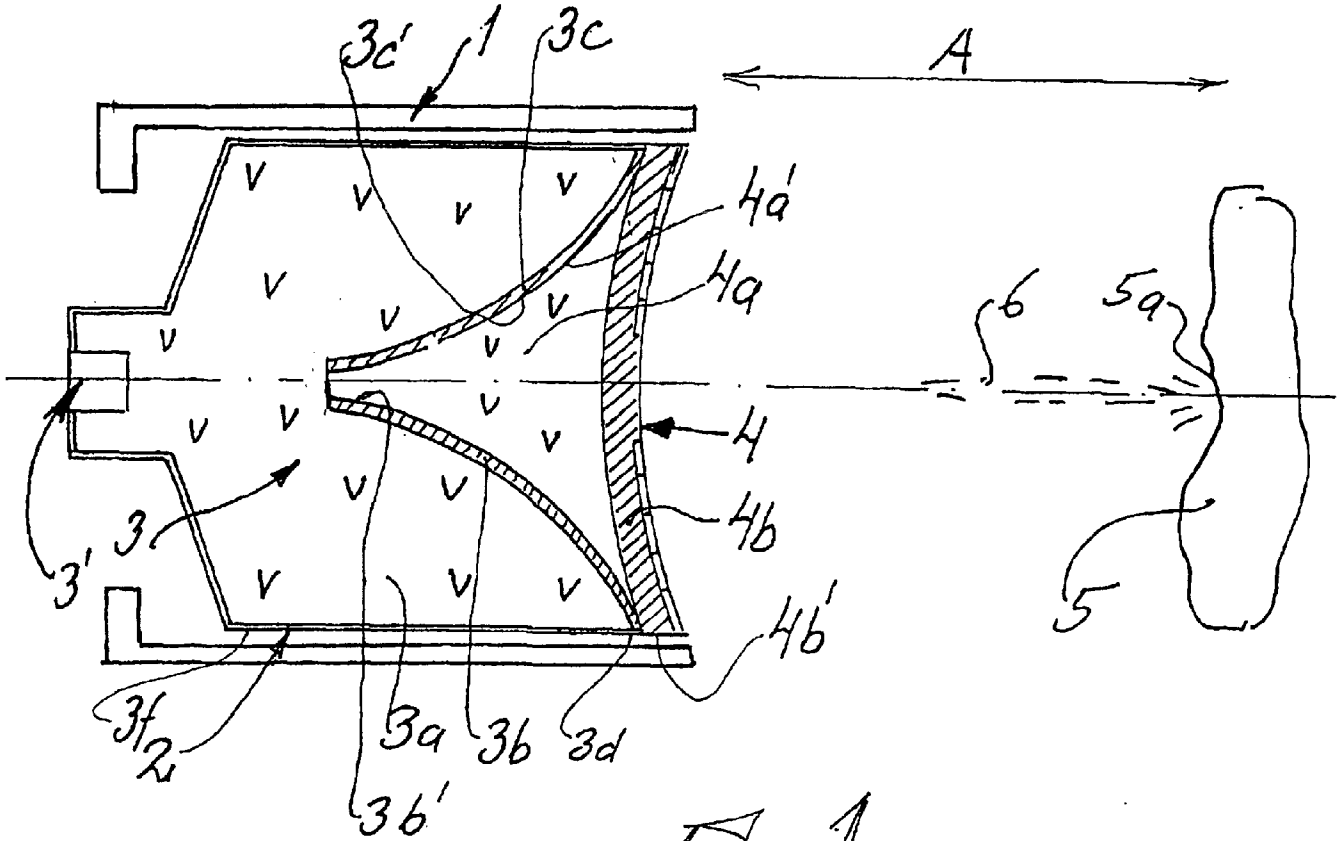

The present invention relates to a device to enable the engagement of targets using a shaped charge function.

The use of a unit of ammunition in the form of a projectile, shell, missile, etc to engage a target by the application of a shaped charge function is already known. The shaped charge is thus matched to the type of target, and there are thereby shaped charges arranged to operate at short standoff distances to the target or surface of the target, compared with a so-called jetting shaped charge function that operates at a very small standoff distance (e.g. 100 millimetres) from the surface of the target to achieve a hole in, or an impact on, the target. The use of EFP (explosively formed projectile/penetrator) shaped charges with which one can begin to attack a target or surface of a target at considerably larger standoff distances (e.g. 50 metres) is also already known. Consequently, there are major differences in effectiveness against different types of target, and to optimise effect in each case it is vital to use the correct ammunition unit with the correct shaped charge. The use of different ammunition units optimised for different engagement situations is thereby already known.

There is a need, however, to be able to reduce the assortment of ammunition units. The objective of the present invention is to resolve this problem, and to propose that modular charge components be used to enable one and the same ammunition unit to be matched to, or be re-configured for, the type of target in question, i.e. so that the ammunition unit can be assigned a shaped charge function at the deployment site (e.g. prior to firing, launch or weapon release) that is optimised for the target to be engaged on the occasion in question. It is thus necessary that re-configuration for the various engagement occasions can achieve optimisation for the target in question, and that it can be performed in a safe and, primarily, technically simple manner. There is even a desire that the new function with modular charges shall not unduly intrude upon the total costs in the system as such. The present invention is envisaged to resolve this problem too.

The main characteristic features of the arrangement initially mentioned are, among other things, that an ammunition unit in the form of a projectile, shell, missile, etc is arranged to operate with at least two modular charge configurations, in the first of which the ammunition unit incorporates a first modular charge or modular array that projects a first shaped charge function—such as a jetting shaped charge—while in the second configuration the first modular charge or modular array is conjoined with a second modular charge or modular array that projects a second shaped charge function such as an EFP function. Another feature is that the ammunition unit is arranged to enable changeover from the first configuration to the second before firing, launch or release of the ammunition unit.

Thus in embodiments of the invention concept the second modular charge or modular array eliminates the shaped charge function effected by the first modular charge or modular array when the modules or arrays are arranged in conjoined mode. The first modular charge incorporates a liner—forwards facing and in the form of a funnel or cone—that produces the first shaped charge function. The second modular charge is thus designed with a rear section that exhibits a corresponding form to that of the said funnel or cone form. In the second case the second modular charge is conjoined with the first modular charge via the said rear section which, in conjoined mode, is inserted in the funnel or cone form of the first modular charge. In a preferred embodiment the fit between the form of the rear section of the second modular charge and the funnel or cone form of the first modular charge is a salient feature, and exhibits an extremely precise fit in the preferred embodiment.

The liner that produces the second shaped charge function exhibits a lateral face that conjoins with the lateral face of the first modular charge, and the first mentioned lateral face can be considered to form a continuation or constituent part of the latter mentioned lateral face. The said rear section preferably consists of or contains explosive material, and the first modular charge preferably incorporates an essentially cylindrical container enclosing the explosive material of the first modular charge. Parts of the explosive material in the first and second modular charges conjoin with each other in the said conjoined mode. In a preferred embodiment the ammunition unit at delivery incorporates both modular charges or modular arrays in conjoined state. If the first charge configuration shall be used the second modular charge or modular array is thus removed. The ammunition device in one embodiment is arranged with a casing or structural element that is removable when changing over between the first and second configuration modes. After the changeover it shall be possible to refit the said casing or structural element to enable the ammunition unit to be fired, launched or released. Additional variants of the present invention are disclosed in the subsequent Patent Claims and the detailed description.

The above proposals enable the new changeover function to be achieved without any significant financial burden to the system in its entirety. The present invention exploits the insight that the explosive charge represents a relatively small value with regard to the total system, in which the functions for guidance, propulsion, actuation, etc represent the major costs. The redundancy thereby achieved by the use of two different types of modular charges or modular arrays in which one modular charge or modular array is discarded in certain engagement situations is thus not a burden to the system as such. Changeover can be arranged in an already known way, such as by means of screw joint(s), by means of which the casing or structural element can be removed and then refitted to achieve reliable closure. The modular charges as such can also consist of conventional constructions and designs.

Figure 2:
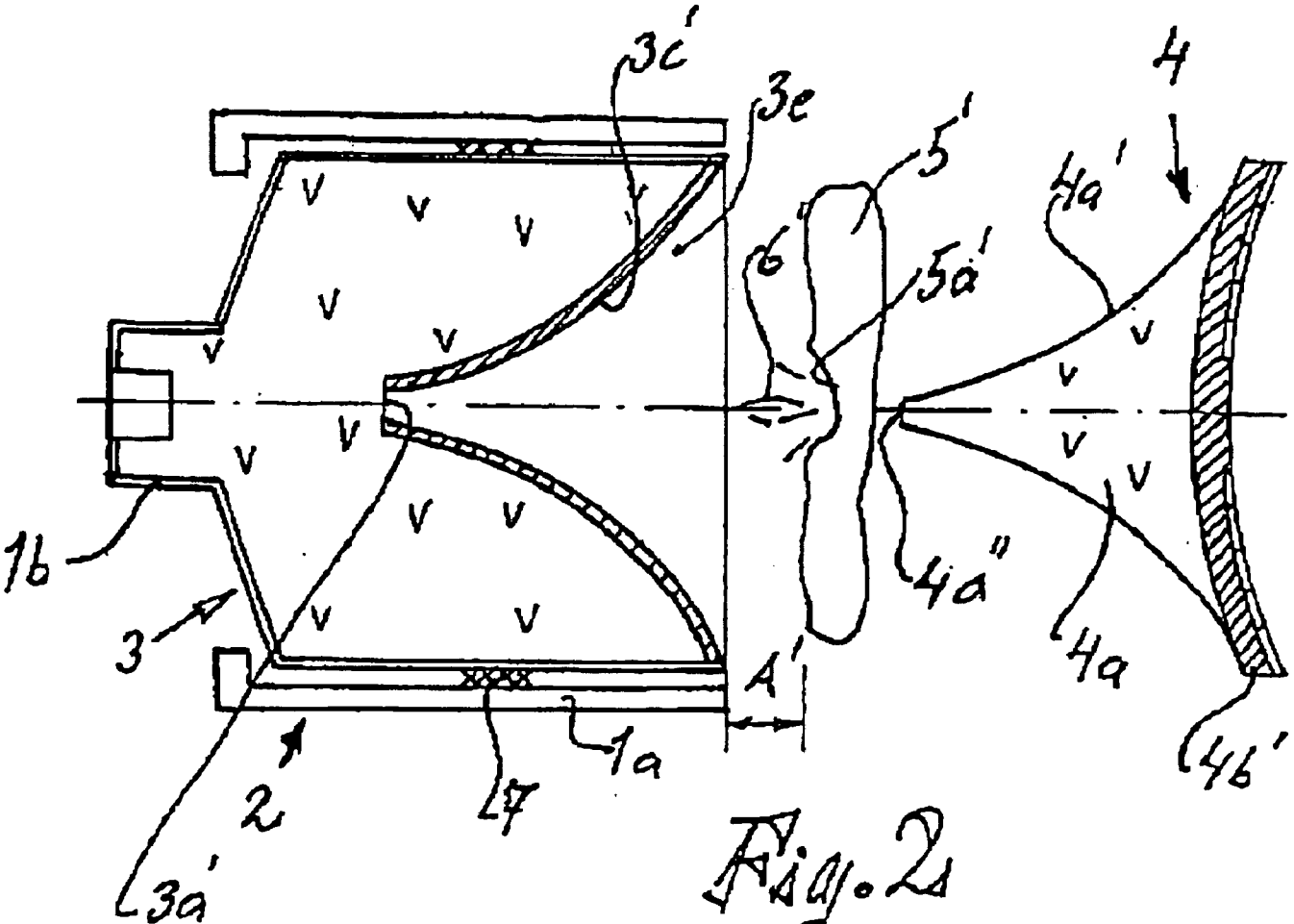

A currently proposed design for a device as claimed in the present invention is described below with reference to the appended FIGS. 1 and 2 in which FIG. 1 shows a longitudinal section of a modular charge configuration comprising first and second modular charges in conjoined mode, and FIG. 2 shows a longitudinal section of the modular charges illustrated in FIG. 1, but with the second modular charge removed from the first modular charge.

Number 1 in FIG. 1 symbolises parts of an ammunition unit in accordance with the arrangement donated 2. The explosive charge arrangement incorporates an initiation function symbolised by 3'. As claimed in the present invention the explosive charge arrangement comprises two modular charges of which the first modular charge is designated 3 and the second modular charge is designated 4. Modular charge 3 comprises explosive 3*a* and a trumpet formed, shaped charge effecting inner cone illustrated in FIG. 1 by section 3*b* and 3*c*. The inner cone sections 3*b*, 3*c* extend from the frontal part 3*d* of the modular charge 3 inwards towards the central part of the modular charge. Sections 3*b* and 3*c* can exhibit other curvatures or extensions and, for example, may be essentially cone shaped. The second modular charge 4 comprises a rear section 4*a* comprising or consisting of explosive. The second modular charge also comprises a frontally concave frontal liner 4*b* that effects shaped charge function. The rear section 4*a* thus exhibits a form that conjoins with walls of the space formed between 3*b*, 3*c*. As claimed in the present invention the fit between the outer surface 4*a*' of the rear section and the inner surfaces 3*c*' and 3*b*' is very precise.

Sections 3*b*, 3*c* are also arranged so that the first modular charge can effect a jetting shaped charge function when in a mode separated from the second modular charge. In the conjoined mode for modular charges 3 and 4 illustrated in FIG. 1 the explosive charge arrangement operates with a shaped charge function effected by liner 4*b*. The latter function in the embodiment example constitutes an EFP shaped charge function. The explosive charge arrangement 2 can thus function for a large standoff A to a target 5 that is to be engaged using the shaped charge function in question, and the resultant explosively formed projectile 6 will attack the target in a concentrated zone 5*a*. The standoff distance A may be, for example, 50 metres.

In FIG. 2 the second modular charge 4 has been separated from modular charge 3. The space in the funnel shaped part bounded by sections 3*b*, 3*c* is designated 3*e*. FIG. 2 shows the shape of the rear section 4*a* of modular charge 4 and its matching shape in relation to space 3*e*. The shape of surfaces 3*c*' and 4*a*' is also illustrated. In this embodiment modular charge 4 is not used and is discarded. Modular charge 3 thus operates independently from modular charge 4, and can effect its shaped charge function which is of said jetting type. Consequently, the ammunition unit or explosive charge arrangement 2 can in this case be used to engage a target that is at standoff distance A' when ammunition unit 1 is triggered, standoff A' being relatively small—e.g. 100 millimetres—in relation to standoff A. The shaped charge jet projected by modular charge 3 is designated 6'. In FIG. 2 a screw joint on the casing of the device is symbolised by 7. The screw joint can comprise an internal and external thread of already known type. The casing or structural element 1*a* can thereby be temporarily separated from the casing or structural element 1*b*. The ammunition unit is supplied with the explosive charge arrangement in conjoined mode as illustrated in FIG. 1. For a possible changeover to the mode illustrated in FIG. 2 the casing or structural element 1*a* is thus unscrewed to enable modular charge 4 to be removed, after which the casing or structural element 1*a* is screwed back onto casing or structural element 1*b*.

It is envisaged in accordance with the above that modular charge 3 in principle can comprise a number of first modules, explosive compositions and other configurations, and that in such cases reference is made to a first modular array. In a corresponding way the second modular charge 4 can consist of more than one module, whereby such an arrangement can be envisaged as a second modular array. As claimed in the present invention the first modular charge can interact with a second modular array, and the second modular charge can interact with a first modular array. FIG. 2 also shows that the rear section 4*a* exhibits a rear plane 4*a*" that is circular and extends at right angles to the plane of the figure illustrated. In the conjoined mode illustrated in FIG. 1 this end plane 4*a*" butts against an inner surface 3*a*' in the explosive 3*a* of the first modular charge. Thus in conjoined mode there is mechanical contact between parts 4*a* and 3*a*.

Liner 4*b* on the second modular charge 4 exhibits a lateral face 4*b*'. This lateral face extends adjacent to an outer surface 3*f* of the casing or structural element of the first modular charge. Lateral face 4*b*' can be considered to constitute a continuation of outer surface 3*f*. The first modular charge in principle comprises a casing that encases the explosive 3*a*, with the said initiating device 3' arranged at the rear of the said casing. Rear section 4*a* consists of a self-supporting explosive charge.

The present invention is not limited to the design examples described above, but can be subjected to modifications within the framework of the subsequent Patent Claims and the invention concept.

What is claimed is:

1. A modular ammunition unit comprising:

a first modular shaped charge having a first liner on a forward portion of the first shaped charge, wherein the first liner has a funnel or cone shape;

a structural element housing at least a part of the first modular shaped charge; and a second modular shaped charge having a concave frontal second liner, wherein a rear section of the second shaped charge has a funnel or cone shape that is a complementary fit with first liner so that the rear section of the second shaped charge can be inserted into the first liner, wherein the second modular shaped charge is removably engageable with the ammunition unit to enable firing of the ammunition unit in at least two modes.

2. The modular ammunition unit of claim 1, wherein the ammunition unit operates in a first mode when the second modular shaped charge is not fitted in the first modular shaped charge and in a second mode when the second modular shaped charge is fitted in the first modular shaped charge.

3. The modular ammunition unit of claim 2, wherein:

the first modular shaped charge is arranged to engage a target at a first standoff distance when the ammunition unit is in the first mode; and the ammunition unit is arranged to engage a target at a second standoff distance when the ammunition unit is in the second mode, wherein the second standoff distance is larger than the first standoff distance.

4. The modular ammunition unit of claim 3, wherein the second standoff distance is about 50 meters.

5. The modular ammunition unit of claim 3, wherein a rear section of the first modular shaped charge is essentially cylindrical.

6. The modular ammunition unit of claim 3, wherein the rear section of the second modular shaped charge is in direct contact with the first modular shaped charge when the ammunition unit is in the second mode.

7. The modular ammunition unit of claim 3, wherein part of the structural element is removable in order to change the ammunition unit from the second mode to the first mode.

8. The modular ammunition unit of claim 7, wherein the structural element comnprises:

a first structural element; and a second structural element connected to the first structural element by a hinge.

9. The modular ammunition unit of claim 3, wherein in explosive charge of the first modular shaped charge comprises a plurality of initiation points that enable operation of the ammunition unit to effect a jet, a knife blade and a cruciform shaped projectile and a fragmentation warhead effect.

10. The modular ammunition unit of claim 3, wherein the first modular shaped charge is a modular array.

11. The modular ammunition unit of claim 3, wherein the second modular shaped charge is a modular array.

12. The modular ammunition unit of claim 3, wherein a front portion of the first liner contacts a rear portion of the second liner.

13. A modular ammunition unit comprising:

a first modular shaped charge having an essentially cylindrical rear section and first liner on a forward portion of the first modular shaped charge, wherein the first liner has a funnel or cone shape;

a structural element housing at least a part of the first modular shaped charge; and a second modular shaped charge having a concave frontal second liner, wherein a rear section of the second shaped charge has a funnel or cone shape that is complementary fit with first liner so that the rear section of the second shaped charge can be inserted into the first liner, wherein the second modular shaped charge is removably engageable with the ammunition unit to enable firing of the ammunition unit in at least two modes, the ammunition unit operating in a first mode when the second modular shaped charge is not fitted in the first modular shaped charge and in a second mode when the second modular shaped charge is fitted in the first modular shaped charge, the first modular shaped charge is arranged to engage a target at a first standoff distance when the ammunition unit is in the first mode and arranged to engage a target at a second standoff distance when the ammunition unit is in the second mode, wherein the second standoff distance is larger than the first standoff distance, the rear section of the second modular shaped charge is in direct contact with the first modular shaped charge when the ammunition unit is in the second mode, and part of the structural element is removable in order to change the ammunition unit from the second mode to the first mode.

14. The modular ammunition unit of claim 13, wherein the second standoff distance is about 50 meters.

15. The modular ammunition unit of claim 13, wherein an explosive charge of the first modular shaped charge comprises a plurality of initiation points that enable operation of the ammunition unit to effect a jet, a knife blade and a cruciform shaped projectile and a fragmentation warhead effect.

16. The modular ammunition unit of claim 13, wherein the first modular charge is a modular array.

17. The modular ammunition unit of claim 13, wherein the second modular charge is a modular array.

18. The modular ammunition unit of claim 13, wherein a front portion of the first liner contacts a rear portion of the second liner.

* * * * *